United States Patent [19]

Chamberlin

[11] 4,211,805

[45] Jul. 8, 1980

[54] SELF-ADHESIVE LABELING ARTICLE

[75] Inventor: Coleman R. Chamberlin, Thompson Ridge, N.Y.

[73] Assignee: Cel-U-Dex, Inc., New Windsor, N.Y.

[21] Appl. No.: 946,267

[22] Filed: Sep. 27, 1978

Related U.S. Application Data

[63] Continuation of Ser. No. 801,090, May 27, 1977, abandoned.

[51] Int. Cl.[2] ..... G09F 3/20

[52] U.S. Cl. ..... 428/40; 40/16; 40/10 D; 40/19; 428/36; 428/41

[58] Field of Search ..... 40/16, 16.4, 10 D, 19, 40/125 A; 428/36, 40, 41, 43

[56] References Cited

U.S. PATENT DOCUMENTS

| | | | |
|---|---|---|---|
| 1,071,625 | 8/1913 | Morrell | 40/16 X |
| 2,152,227 | 3/1939 | Veit | 40/16 X |
| 2,264,628 | 12/1941 | Engert et al. | 40/125 |
| 2,952,087 | 9/1960 | Chamberlin | 40/16 |
| 3,053,430 | 9/1962 | Yardbough et al. | 40/16 X |
| 3,343,289 | 9/1967 | Chamberlin | 40/16 |
| 3,741,786 | 6/1973 | Torrey | 428/40 |

*Primary Examiner*—George F. Lesmes
*Assistant Examiner*—Alexander S. Thomas
*Attorney, Agent, or Firm*—Sprung, Felfe, Horn, Lynch & Kramer

[57] ABSTRACT

In a preferred embodiment, there is provided an elongated tubular label holder having a contact adhesive backing by diagonally extending adhesive strips relative to a longitudinal axis of the elongated tubular label holder, the adhesive coatings extending over a major proportion of the width of the tubular label holder whereby, relative to total area of the rearward face of the tubular label holder upper and lower width-edges are firmly securable along the elongated length of the tubular label holder; the adhesive strips are spaced-apart and define diagonal spaces which provide cut-lines (imaginary) for the cutting thereof when the data insert card is in a withdrawn state; the data insert card is provided or cut with a full portion which when in the inserted state extends beyond the diagonally-cut open-end edge of the elongated tubular label holder as a handle-grasping area.

6 Claims, 7 Drawing Figures

PRIOR ART
FIG. A.
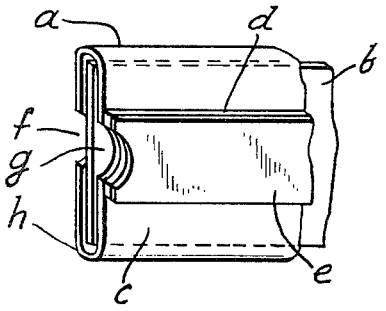
PRIOR ART
FIG. B.
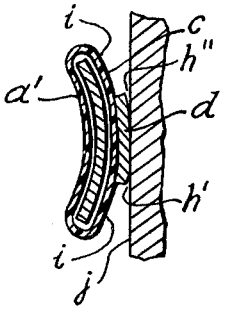
FIG. 1A.
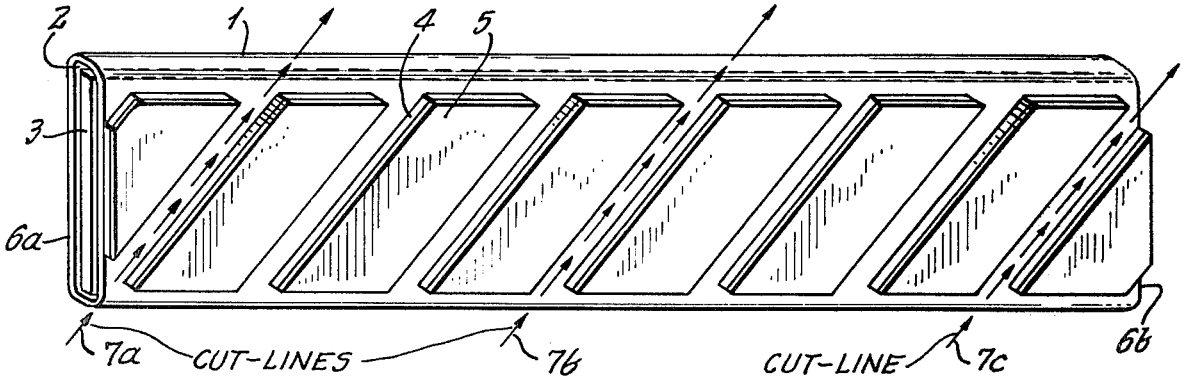
FIG. 1B.
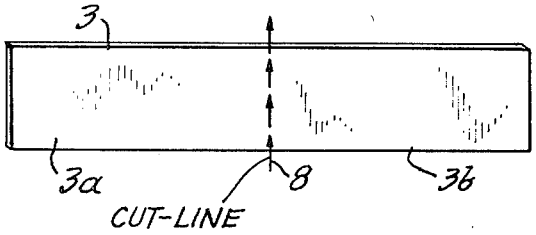
FIG. 1C.
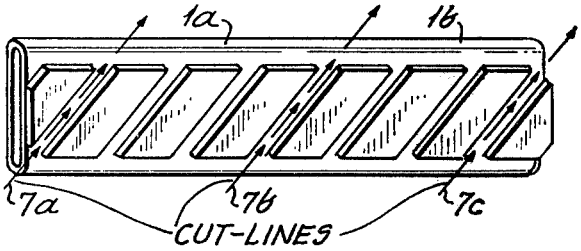
FIG. 2.
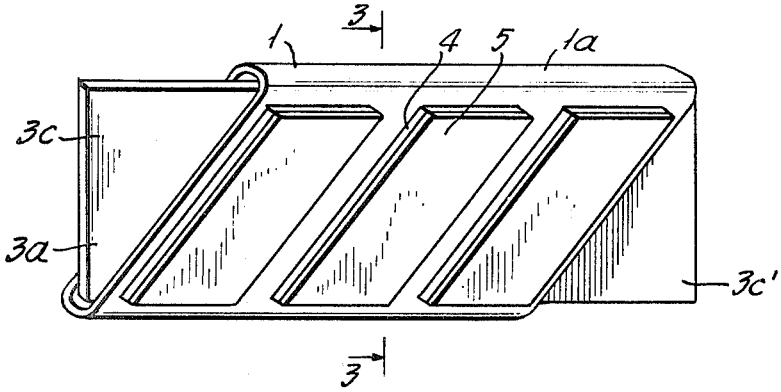
FIG. 3.
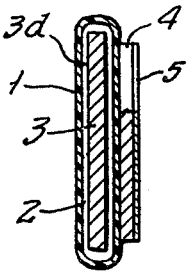

SELF-ADHESIVE LABELING ARTICLE

This application is a continuation of Ser. No. 801,090, filed May 27, 1977, now abandoned.

This invention relates to a novel label holder of improved adherence and durability and improved utility for insertion and withdrawal of data insert card, i.e. indicia label.

BACKGROUND OF THE INVENTION

Prior to the present invention, there have been various problems with heretofore-available labels of the type adhered by the consumer to a substrate surface to be labeled. The Prior Art FIGS. A and B typically illustrate these problems. In the Prior Art FIG. A, there is disclosed an in-part view in rear perspective view of one end of a self-adhesive label holder of conventional design, together with the specially-added end-notch cut-out often ordered by consumers in order to facilitate the insertion and removal intermittently of a data insert card for the identifying or indexing of the contents being labeled. It will be observed that the tubular holder a has insert b therein, and that the rearward holder face c has a contact adhesive layer d masked by masking sheet e, and that the cut-out f through the tubular holder (both sides/faces) and the adhesive coating and masking sheet, provides a handle portion g of the insert card b, and that the masking sheet e and covered adhesive layer d cover solely and merely a central portion of the rearward holder face c. Because of the additional labor involved, it is much more costly to the purchaser who directs that a cut-out f be provided prior to delivery, in the manner shown as cut-out f. Also, because such self-adhesive label holders are and must be a low cost and low priced item, it is essential that the manufacturing cost and cost of components thereof be held to an absolute minimum, since otherwise it would be impossible to manufacture and sell at a competitive price. For that reason, only on special order are the cut-outs as cut-out f provided normally, and the width of the adhesive coating (which may conventionally be pure adhesive composition or alternately a tape having contact adhesive on each of opposite faces, adhered to the rearward face of the label holder) is held to a minimum for reasonable performance. That level of performance has, however proved to be often less than adequate, as shown in Prior Art FIG. B, in which in a cross-sectional view there is disclosed the state of an adhered prior art holders such as shown in Prior Art FIG. A; it will be observed that the rearward face is adhered to substrate surface j by the adhesive coating d, which because of the notoreous curling or otherwise knocking and handling abuse, causes the holder a to have curled rearward face i and curled rearward face i', which also results in spaces h and h' between the edges of the adhesive coating d and the substrate surface j. Thus, while this FIG. B is merely symbolic and diagrammatic of the problems, it may be observed that the reading through the forward face a' would be difficult, and the pulled-loose adhesive coating results in a merely loosely-attached label holder a, subject to falling-off and/or to being knocked-off during conventional use of the file or folder or the like which provides the substrate surface j.

SUMMARY OF THE INVENTION

Accordingly, objects of the present invention include the obtaining of a self-adhesive label holder having improved holding and durability of holding characteristics.

Another object is to provide a label holder having an insert open-end thereof extending angularly, typically diagonally, at its edge to obtain a handle area by inserted label portion extending outwardly therebeyond.

Another object is to obtain a label holder and label insert card therefor having jointly improved holding properties and ease of insertion and withdrawal of the label insert card.

Another object is to obtain one or more of the preceding objects while maintaining reduced cost of manufacture and of total materials, whereby competitive sales price may be obtained while maintaining and achieving superior performance of product.

Other objects become apparent from the preceding and following disclosure.

One or more objects of the present invention are obtained by embodiments illustrated herein, while not being limited necessarily to the merely typical embodiments illustrated for improved understanding of the invention which extends to variations and modifications and equivalents thereof obvious to a person skilled in this particular art.

Broadly the invention may be described as a label holder in the nature of an elongated tubular element having a flattened rearward face suitable for adhering to a desired substrate, and having end edges of the open end thereof extending substantially diagonally relative to the longitudinal axis of the elongated tubular element. In a more practical commercial embodiment thereof, however, the diagonal cutting is left to the consumer purchaser, with normally appropriate instructions included with the purchased article, and with there being additionally included the inventive plurality of adhesive coatings (for equivalent adhesive strips) mounted on the rearward face of the tubular element, mounted intermittently spaced-apart in series along the longitudinal axis of the tubular element, and adhesive coatings being preferably contact adhesive, and more preferably having also masking tape or the like, of a removable nature, mounted thereover thereby preventing the adhesive coating from accidentally adhering to other materials before use to mount the tubular element. The adhesive coatings serve dual purposes; by extending over substantially a width of the tubular element, for each adhesive coating, both upper and lower edges of the back (rearward) face of the tubular element may be secured to a substrate surface, preventing any substantial tendency of the tubular element to curl-away from the substrate surface, and giving a wider base of attachment, with regard to width of the tubular element; but additionally, the spaces between consecutive diagonal adhesive coatings provide a guiding space and line of cut, for the subsequent cutting of the tubular element along the diagonal space at the desired length of the tubular element at at-least the one open end thereof, and if desired at opposite open ends, or at any point intermediate between the opposite ends at desired length of the tubular element. While not illustrated, it is possible to indicate the cut-line by printing carried on the rearward face of the tubular element, and/or to have the tubular element etched or scored for easy breaking or snapping-off thereat at the desired point(s). In the embodiment noted-above precut, there may be and preferably is included a label insert having an end portion thereof extending beyond at-least a part of the end-edge of the cut (diagonally-cut) tubular element, when the label insert is in the inserted state, thus providing a handle-portion for easy and convenient grasping for insertion and/or withdrawal with accompanying speed of operation, speed being important to consumers to save valuable office time. The end-edge of the label insert is preferably squared, substantially, accomplished by mere cutting straight-across when the label insert is in a withdrawn state from the tubular holder, cut at a measured distance to correspond substantially with the length of the cut tubular element.

While the advantages of the invention have been set forth above, it should be noted that an additional advantage is the flexibility of adjustment of the present article(s) to the diverse and flexible desires of the various consumers, and to different needs of any consumer. Sometimes a short tubular holder might be desired, while at other times a very long one might be desired. The diagonal spacings avoids also the need or necessity of having to cut-through the thickness of the adhesive coating (or tape) and/or masking thereof.

While the novelty of the invention has been described in preceding disclosure, it should be noted that preferably and normally the elongated tubular element is of transparent plastic, but alternatively could be other than transparent and have a window therein, or the like. The material, plastic or otherwise, may be the same or variation or other than what is normally utilized conventionally in the manufacture of such. In like manner, the insert material may be of any conventinal or desired label insert material, such as typically plastic, paper, cardboard, or the like. As previously stated, the term adhesive coating as used herein is intended to also include obvious equivalents such as adhesively-coated tape or the like, particularly the tape coated on each of opposite faces (top and bottom) with contact adhesive, or contact adhesive on the exposed surface and otherwise attached at the undersurface to the back side of the tubular element. Also, while the label-insert holder is referred to herein as tubular, the term tubular is intended as used herein, to include (within its meaning) any substantially tubular element such as a vessel typically C-shaped—as would be the case where a front window extended the entire length of the tubular element.

The invention may be better understood by making reference to the Figures as follow.

The Prior Art FIGS. A and B have been previously described as a part of the preceding Background discussion.

FIG. 1A illustrates in an end-perspective back view of a preferred commercial embodiment of the elongated tubular element with an insert therein, before trimming (cutting) along the noted-cut lines thereof along the diagonal spaces.

FIG. 1B illustrates the label insert card in a withdrawn state, typical of the appearance of the card in the FIG. 1A embodiment, also shown in the end-perspective view.

FIG. 1C, also in an end-perspective back view the same as FIG. 1A, discloses the elongated tubular element with the label insert card withdrawn therefrom, as would exist at the time of cutting along the noted-cut lines-of-cut along the (as desired) selected spaces.

FIG. 2 illustrates an end-perspective back view of the invention, after the cutting as shown in FIGS. 1B and 1C, and after thereupon inserting the label insert card into the insert space within the elongated (but now-cut) label-holder tubular element, ready for use.

FIG. 3 illustrates a cross-sectional view as taken along line 3—3 of FIG. 2.

DETAILED DESCRIPTION OF THE INVENTION

In greater detail, FIG. 1A illustrates an elongated tubular element 1 having insert opening 2 and label insert 3 inserted within the insert space thereof. Adhesive coating 4 is adhered to the rearward face of elongated tubular element 1, in diagonal strips relative to the longitudinal axis of the elongated tubular element, with the adhesive coatings being in series and spaced-apart from one-another, each adhesive coating being shown to extend substantially across the entire back (rearward) face of the elongated tubular element, along substantially its entire width or a major proportion thereof.

Coated or applied on top of the adhesive coating 4, is a masking or protective sheet or tape 5, of a removable type, to be removed before applying the thereby to-be-exposed adhesive surface to a substrate surface. Typically, commercially, the article is provided cut (as by machine) as squared ends *6a* and *6b*, for both the elongated tubular element 1 and the label insert 3 mounted therein. Cut-lines are defined by the indicative (imaginary) arrows *7a* and *7b* as typical for cutting along diagonal spaces as shown. The label insert 3 of FIG. 1B has an indicated cut-line arrows (which may, if desired, be printed thereon—as alternative cut-lines, which would be printed normally on the back face thereof) 8, thereby dividing the label insert into two portions *3a* and *3b*. In like manner, the cut-lines of the FIG. 1C divide the elongated tubular element into two portions *1a* and *1b*. Accordingly, the cut embodiment of FIG. 2 illustrates portion *3a* inserted within portion *1a*, with the exposed portions *3c* and *3c'* serving as alternate handle portions at each of opposite ends thereof. FIG. 3, taken in cross-section along lines 3—3 of FIG. 2, better illustrated the relative relationships of the parts previously described.

As previously noted, the cutting may take place in the initial manufacture, to sell a FIG. 2 product, or alternatively may be sold a a FIG. 1A product to be later cut by the consumer.

It is within the scope of the invention to make substitution of obvious equivalents, and to vary shapes of edges so long as within the basic spirit of the invention.

I claim:

1. A label holder device for holding substantially rectangular labels, comprising: an elongated tubular element having at least one open end for receiving a given label therein and having a substantially planar longitudinal rear surface, wherein the tubular element is cuttable at different points along the length thereof to obtain a label holder having a desired length substantially equal to the length of the given label; and means for guiding the cutting of the tubular element to configure at least one end of the holder to effect exposure of only one corner of the given label when same is completely inserted in the holder, while imparting the desired length to the holder comprising a plurality of spaced apart adhesive elements disposed on the planar rear surface for affixing the holder to a given plane.

2. The label holder according to claim 1, wherein the guiding means comprises the plurality of spaced apart adhesive element disposed in a series along the length of the rear surface and having at least one side thereof traversing the width of the tubular element diagonally with respect to the longitudinal axis thereof.

3. The label holder according to claim 2, wherein the guiding means effects exposure of two diagonally opposite corners of the label with the overall length of the holder substantially equal to the length of the label.

4. An adhesive-label holder device of claim 2, including means for masking the otherwise exposed surfaces of the plurality of spaced-apart adhesive elements, mounted on rearward exposed surfaces of the plurality such that before removal of the masking means there is prevented a sticking of exposed adhesive surfaces to other materials.

5. An adhesive-label holder device in claim 1, in which said adhesive elements comprise contact adhesive.

6. A label holder device for holding substantially rectangular labels, comprising: an elongated tubular element having at least one open end for receiving a given label therein and having a substantially planar rear surface wherein the length of the tubular element corresponds to the length of the given label to be held and the ends of the tubular element traverse the width of the tubular element diagonally in a straight line with respect to the longitudinal axis thereof to effect exposure of only two diagonally opposite corners of the given label when same is completely inserted in the holder with the length of the tubular element substantially equal to the length of the label; and a plurality of spaced apart adhesive elements disposed on the planar surface for affixing the holder to a given plane and each having at least one side thereof parallel to the ends of the tubular element.

* * * * *